United States Patent [19]

Dimier et al.

[11] Patent Number: 4,709,942

[45] Date of Patent: Dec. 1, 1987

[54] SAFETY SKI BINDING INCLUDING AN AUTOMATIC COMPENSATION MECHANISM

[75] Inventors: Jean-Pierre Dimier, Rumilly; Pierre Rullier, Annecy, both of France

[73] Assignee: Salomon S.A., Annecy, France

[21] Appl. No.: 710,365

[22] Filed: Mar. 11, 1985

[30] Foreign Application Priority Data

Mar. 9, 1984 [FR] France ..... 84 03664

[51] Int. Cl.[4] ..... A63C 9/081

[52] U.S. Cl. ..... 280/618

[58] Field of Search ..... 280/618, 616–617

[56] References Cited

U.S. PATENT DOCUMENTS

| | | | |
|---|---|---|---|
| 2,858,137 | 10/1958 | Marker | 280/625 |
| 4,302,027 | 11/1981 | Himmetsberger et al. | 280/618 |

FOREIGN PATENT DOCUMENTS

| | | |
|---|---|---|
| 1066465 | 10/1959 | Fed. Rep. of Germany . |
| 2461267 | 7/1976 | Fed. Rep. of Germany . |
| 2905837 | 8/1980 | Fed. Rep. of Germany . |
| 3421499 | 12/1984 | Fed. Rep. of Germany . |
| 903887 | 10/1945 | France . |
| 1363895 | 5/1964 | France . |
| 84841 | 3/1965 | France . |
| 2248680 | 5/1975 | France . |
| 2258876 | 8/1975 | France . |
| 2263796 | 10/1975 | France . |
| 2314742 | 1/1977 | France . |
| 2334382 | 7/1977 | France . |
| 2385418 | 10/1978 | France . |
| 2419737 | 10/1979 | France . |
| 2424037 | 11/1979 | France . |
| 2478476 | 9/1981 | France . |
| 2523857 | 9/1983 | France . |
| 2517214 | 3/1984 | France . |
| 8122577 | 3/1984 | France . |
| 2547508 | 12/1984 | France . |
| 2555907 | 6/1985 | France . |
| 8319397 | 6/1985 | France . |
| 8403525 | 6/1985 | France . |
| 2557803 | 7/1985 | France . |
| 8400346 | 7/1985 | France . |
| 2560777 | 9/1985 | France . |
| 60-12083 | 1/1985 | Japan . |

*Primary Examiner*—Nancy A. Swisher

*Attorney, Agent, or Firm*—Sandler & Greenblum

[57] ABSTRACT

A ski binding for compensating for friction between a ski boot and a ski during a frontward and torsional fall. The binding includes a front abutment and a plate positioned under the boot. The plate includes first means for transmitting longitudinal displacement of the plate to the front abutment, and second means for transmitting lateral pivoting of the front abutment to the plate. These two means are distinct from one another so that they can be positioned at different positions. As a result, the first means can be positioned as close as possible to the rotational axis of the front abutment and the second means can be positioned a distance from the rotation axis of the front abutment so that the longitudinal axis of the boot and plate coincide during lateral pivoting of the boot and plate.

37 Claims, 19 Drawing Figures

1a

Ac
C1
C2
X
X'
L1
M1
Ap
1b
C1
C2
L1
M1
1c
C1
C2
L1
M1

F2
F1
M1
1
2
C'1
9
6
C2
C1
C'2
7
8
4
5
M2
F3
F4

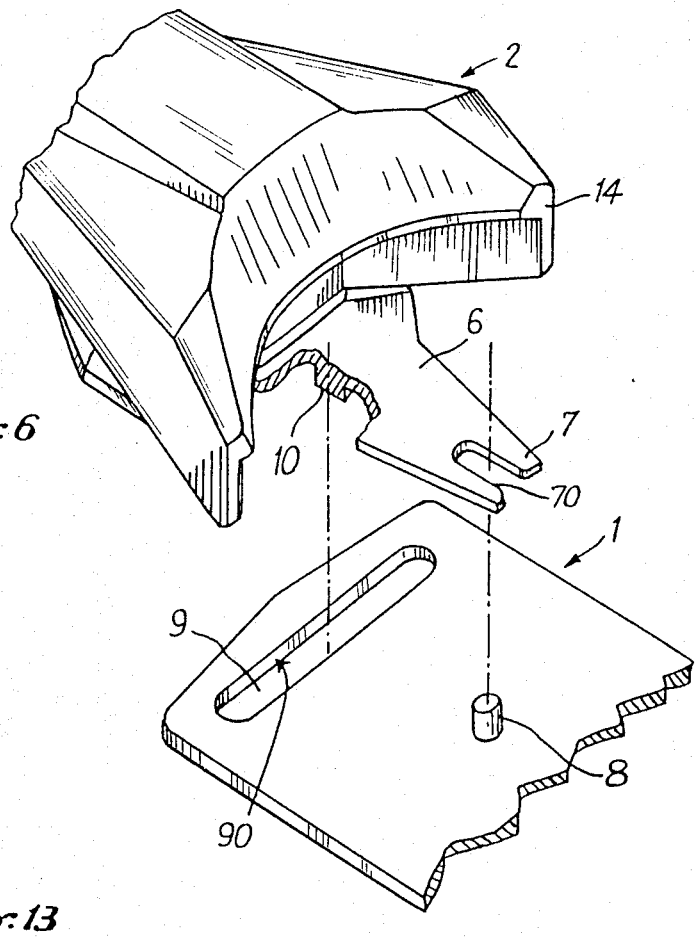
Fig: 6
Fig: 13
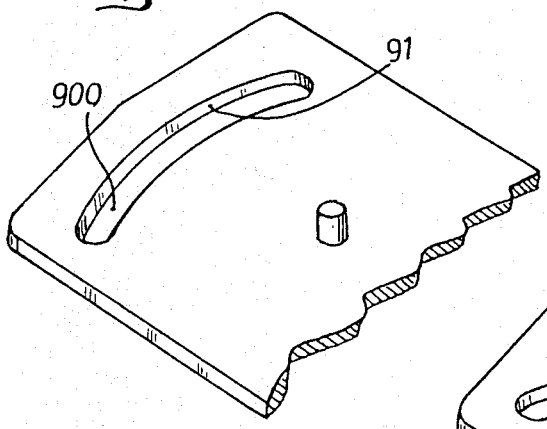
Fig: 14
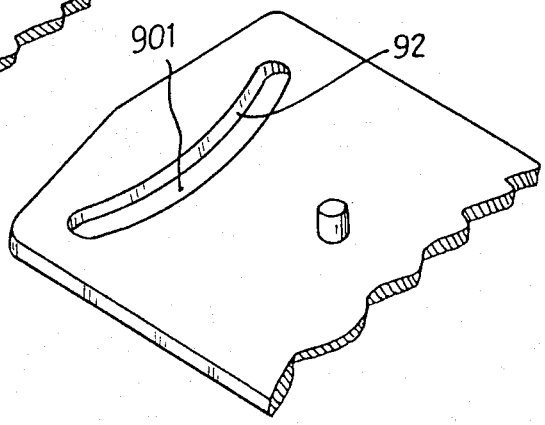

SAFETY SKI BINDING INCLUDING AN AUTOMATIC COMPENSATION MECHANISM

BACKGROUND OF THE INVENTION

1. Field of the Invention

The present invention relates to a safety ski binding comprising front and rear retention elements for retaining the boot on the ski. The front element is generally called a front abutment or toe binding and the rear element is generally called a heel binding.

2. Description of Background Information

The front abutment of a safety ski binding is adapted to laterally pivot against the bias of an elastic mechanism which can be adjusted to a predetermined value. As a result, when excessive torsional forces act on the leg of the skier which are greater than the predetermined value, the boot and the front abutment pivot in the lateral direction, thereby freeing the boot of the skier from the front abutment.

Conventional safety bindings that use this laterally pivotable front abutment suffer a number of disadvantages, particularly when a torsional fall which causes the boot of the skier to laterally pivot, is combined with a frontward fall. In this case, the bottom of the front of the sole of the boot is pressed downwardly against the ski with a substantial force. This downward force of the front of the sole of the boot on the ski creates friction between the bottom of the sole and a support surface of the ski. This frictional force is appreciable and opposes lateral release of the boot, which is dangerous to the skier.

Various bindings have been designed to compensate for this frictional resistance to lateral release of the boot. For example, German Pat. No. 29 05 837 places a sensor under the front of the sole of the boot to act on the latching mechanism of the binding. This sensor comprises a pedal which is actuated when the front of the boot presses downwardly on the pedal during a frontward fall. The pedal compensates for the friction of the sole of the boot on the ski by reducing the release threshold of the front abutment above which lateral release of the boot occurs. This release threshold is reduced by an amount equal to the value of the friction generated by the sole of the boot against the ski.

Another binding which attempts to solve this problem is French Pat. No. 2,523,857. In this patent, the compensation mechanism described in French Pat. No. 2,314,742 of June 20, 1975 is used. French Pat. No. 2,314,742 described a front abutment in which the elastic system comprises a spring supported against two tiltable elements journalled relative to one another. During a rearward fall the lifting of the front of the boot causes the rotation of one of the tiltable elements with respect to the other, thereby dividing the bias of the spring into two components. This dividing of the bias of the spring into two components diminishes the bias against lateral pivoting so as to compensate for the friction between the boot and the ski.

In French Pat. No. 2,523,857, the rearward fall compensation mechanism of U.S. Pat. No. 2,314,742 is used to compensate for friction between the boot and the ski during a forward fall. This is accomplished by attaching a mobile element of the abutment to a plate which exerts an upward pressure on the bottom of the mobile element, thereby causing a torque on the mobile element which pivots the mobile element upwardly in the case of a rearward fall. As a result, a compensation effect is automatically obtained by diminishing the elastic bias of the movable element retaining the front of the boot against lateral pivoting.

French Certificate of Addition Application No. 8319397 of Dec. 5, 1983 provides a different solution to the problem of friction between the boot and the ski. In this application, a pivotable plate is provided which exerts, in the event of a frontward fall, a rearward of traction force on the front abutment. As described in this Certificate of Addition and as described in the principle patent, French Pat. No. 8310819, which are hereby incorporated by reference, the abutment is of a type which pivots around one of two pivot axes positioned symmetrically on both sides of the plane of symmetry of the abutment. This tractional force causes a torque to be applied to the abutment which causes an additional rotation of the abutment to compensate for the friction of the boot against the ski which tends to limit such rotation.

In these two types of bindings, a pivotable plate is used which slides in the longitudinal direction of the binding. The plate is adapted to support a rear heel binding so that the force of lifting the heel of the boot causes a rearward movement of the plate. Because the plate is attached to the front abutment, this rearward movement of the plate transmits a tractional force to the abutment in the rearward direction. However, in these two types of bindings, the pivotable plate and the front abutment are attached to one another by a simple pivot. As a result, if the pivot is positioned so that the longitudinal axis of the boot coincides with the longitudinal axis of the plate during lateral pivoting, this pivot is positioned a substantial distance from the pivot axis of the front abutment, which is disadvantageous because the pivot at which the traction force of the plate is applied to the abutment is not as close as possible to the rotation axis of the abutment. If the position of the pivot is moved closer to the pivot axis of the front abutment, the longitudinal axis of the boot will not coincide with the longitudinal axis of the plate during lateral pivoting, which is also disadvantageous. Therefore, there is a need for a linking mechanism between the plate and the front abutment that permits that portion of the plate which transmits the traction force to the front abutment to be as close as possible to the rotation axis of the front abutment, will at the same time permit the longitudinal axis of the boot to coincide with the longitudinal axis of the plate during lateral pivoting.

SUMMARY OF THE INVENTION

It is an object of the present invention to provide a binding in which the point at which the plate provides a traction force on the front abutment is as close as possible to the rotation axis of the front abutment, while at the same time permitting the longitudinal axis of the boot to coincide with the longitudinal axis of the plate during lateral pivoting.

This objective is achieved in the present invention by using two separate elements for connecting the plate to the front abutment. One linking element links the plate with the front abutment during longitudinal displacement of the plate, while the other linking element links the plate with the front abutment during lateral pivoting of the plate and front abutment. By virtue of this structure, one obtains a considerable improvement in the operation of the binding. More specifically, the linking between the plate and the binding during the longitudinal displacement of the plate can be made as close as possible to the rotational axis of the abutment (or transverse plane passing through two rotation axes of the front abutment when the front abutment rotates around one of two rotation axes) while at the same time permitting the linking between the plate and the front abutment during lateral pivoting to be at the predetermined distance from the rotation axis of the abutment which permits the longitudinal axis of the boot to coincide with the longitudinal axis of the plate during lateral pivoting.

The present invention in one embodiment comprises a safety binding having a front abutment for holding a boot on a ski and a vertical pivot around which an element of the binding is adapted to pivot. The binding comprises an element positioned under the boot. This element is adapted to pivot around a substantially vertical axis passing through the vertical pivot. The element is adapted to be displaced in the longitudinal direction of the binding with respect to the vertical pivot. This element comprises a first means for linking the element to the front abutment. This first linking means links the element with the front abutment during longitudinal displacement of the element. The element also comprises a second means from linking the element to the front abutment. This second linking means links the element to the front abutment during the pivoting of the element around the vertical pivot. The first and second linking means are distinct from one another.

In one embodiment, the present invention comprises the above decribed element in combination with the front abutment and/or in combination with the vertical pivot. In still another embodiment, the boot with which the safety binding of the present invention is used comprises a heel portion. When such a boot is used, the binding further comprises a heel binding positioned on the element and which is adapted to hold the heel portion of the boot. In still another embodiment, the element which is positioned under the boot is in the form of a plate.

This element can further comprise means for slidingly connecting the element to the vertical pivot so that the element is adapted to slide in the longitudinal direction with respect to the vertical pivot. This connecting means comprises a window in the element. This window is positioned so that the vertical pivot extends through this window. The length of the window in the longitudinal direction of the element is greater than the diameter of the vertical pivot.

The binding can also include a means for pivotally connecting the element to the vertical pivot so that the element is adapted to pivot around a substantially vertical axis passing through the vertical pivot. In this embodiment, the pivotally connecting means comprises the same window described above. The window is positioned so that the vertical pivot extends through the window.

In addition, the first linking means can comprise means for applying a traction force in the longitudinal direction to the front abutment in response to the application of a force in the longitudinal direction to the element. In still another embodiment, the front abutment is adapted to laterally pivot, and second linking means comprises means for transmitting lateral pivoting of the front abutment to the element so that the element lateral pivots with the front abutment.

In addition, the first linking means can comprise means for applying a traction force in the longitudinal direction to the front abutment in response to longitudinal displacement of the element.

In addition, the front abutment is adapted to rotate about an axis, and the first and second linking means are positioned between the rotation axis of the front abutment and the vertical pivot axis of the element. In one embodiment, the axis of rotation of the front abutment can be substantially vertical. In still another embodiment, the first linking means is positioned between the second linking means and the rotation axis of the front abutment.

The front abutment can comprise a body portion and a tongue. The rotation axis of the front abutment passes through the body portion of the front abutment. In addition, the first linking means further comprises means for integrally linking the element with the front abutment. Also, the first linking means is positioned on the tongue immediately adjacent the body portion of the front abutment. In this manner, the first linking means is positioned as close as possible to the rotation axis of the front abutment.

In one embodiment, the first linking means is positioned between approximately 10 and 40 mm from the rotation axis of the front abutment. Also, the second linking means can be positioned between approximately 50 and 90 mm from the rotation axis of the front abutment.

The boot and the element each comprise a longitudinal axis and each are adapted to laterally pivot. The second linking means comprises means for integrally linking the element and the front abutment. In addition, the second linking means is positioned at a distance from the rotation axis of the front abutment such that the longitudinal axes of the boot and the element substantially coincide during lateral pivoting of the boot and the element.

In addition, at least one of the first and second linking means comprises a first ramp and a first projection to engage this first ramp. In addition, the element has a front end portion and the first linking element comprises the first ramp and the first projection in one embodiment. The first projection is integral with the front abutment and the first ramp comprises and transverse ramp positioned at the front end portion of the element. In one embodiment, the transverse ramp may be rectilinear in shape. In another embodiment, the transverse ramp may be curved.

In still another embodiment, the element further comprises a window therein, adapted to receive the first projection. The window comprises a front end and it is this front end of the window that comprises the first ramp.

The second linking element comprises a second projection and a second ramp. This second projection is positioned at the front end portion of the element and the second ramp is integral with the front abutment and extends approximately in the longitudinal direction of the binding. The front abutment further comprises a tongue extending rearwardly from the front abutment. This tongue comprises an opening therein which extends in the longitudinal direction of the binding so that the second ramp is positioned in the opening of the tongue.

In an alternative embodiment the element can further comprise a front portion, and the second linking means comprises a tongue and a first pin. The tongue is integral with the front abutment. This tongue comprises a fork attached to the tongue. The fork comprises two spaced apart arms. The first pin is supported by the element and is adapted to slidingly engage between the two spaced apart arms of the fork. In this embodiment, the first linking means comprises a window and a second pin. The window is positioned on the front portion of the second element and the second pin is supported by the tongue so that the window is adapted to receive the second pin therein.

In still another embodiment, the second linking means comprises a tongue and a pivoting element. The tongue is attached to the front abutment and the pivoting element is pivotally attached to the element. The pivoting element has an opening therein adapted to receive the tongue. The pivoting element is adapted to pivot in response to pivoting of the front abutment. In this embodiment, the element can further comprise a front end portion and the pivoting element is pivotally attached to the front end portion. The pivoting element can also comprise a substantially circular pin. In this embodiment, the second linking means further comprises a housing attached to the front end portion of the element. The housing comprises a substantially circular opening adapted to receive the substantially circular pin. This substantially circular pin is adapted to substantially freely pivot in the substantially circular opening. In addition, the tongue can be substantially rectangular in shape and the opening in the pivoting element can be substantially rectangular in shape. Also, the housing can further comprise a front end portion connected to the substantially circular portion. This front end portion of the housing can have a width substantially greater than the width of the tongue to permit the lateral pivoting of the tongue in the housing.

The first linking means can also comprise a first pin and a ramp. The first pin is integral with the tongue, and the ramp is attached to the element. Also, the ramp is positioned in front of and adjacent to the pin so that rearward displacement of the ramp causes a traction force on the pin, the tongue, and the front abutment. The element can also comprise a front end portion having a window therein. In this embodiment, the first linking means further comprises a plate comprising a second pin thereon. The window in the element is adapted to receive the second pin therein and the plate further comprises the ramp mentioned above. The plate can also comprise a front end portion and a rear end portion. The ramp is positioned at the front end portion of the plate and the second pin is positioned at the rear end portion of the plate.

In still another embodiment, the invention relates to the binding discussed above in combination with the front abutment. In this embodiment, the boot which is to be used with this binding can comprise an upper having a front tip. The front abutment comprises a rear portion and a support positioned on the rear portion. This support supports the front tip of the upper of the boot. Also, the front abutment can further comprise means for adjusting the height of the support. This adjusting means can comprise an adjustment screw.

The present invention can also comprise the binding discussed above in combination with the front abutment. In this embodiment, the front abutment can be attached to the element and the front abutment comprises means for pivoting the front abutment about two axes of rotation positioned symmetrically on both sides of the longitudinal median plane of the front abutment.

In still another embodiment, the present invention comprises the binding discussed above in combination with a front abutment comprising a jaw and means for compensating for friction between the boot and the ski. In this embodiment, the element is attached to the front abutment and the compensation means is actuated by upward pivoting of the jaw.

In still another embodiment, the present invention comprises the binding discussed above in combination with a heel binding positioned on the element. The heel binding can comprise a jaw and two lateral arms. The jaw holds the boot, and the two lateral arms connect the jaw with the element. The two lateral arms form a transverse axis around which the jaw is adapted to be displaced, and the lateral arms are journalled on the element around another transverse axis positioned under the boot.

BRIEF DESCRIPTION OF THE DRAWINGS

The invention will now be described with reference to the attached drawings to facilitate understanding of the invention, in which:

FIG. 6 illustrates a partial perspective view of the binding which is exploded and partailly cut away and which is magnified to show an enlarged view of the two linking mechanisms seen in FIGS. 3–5;

FIGS. 13 and 14 illustrate two partial perspective views illustrating two additional embodiments of the present invention;

DETAILED DESCRIPTION OF PREFERRED EMBODIMENTS

Figure 1:
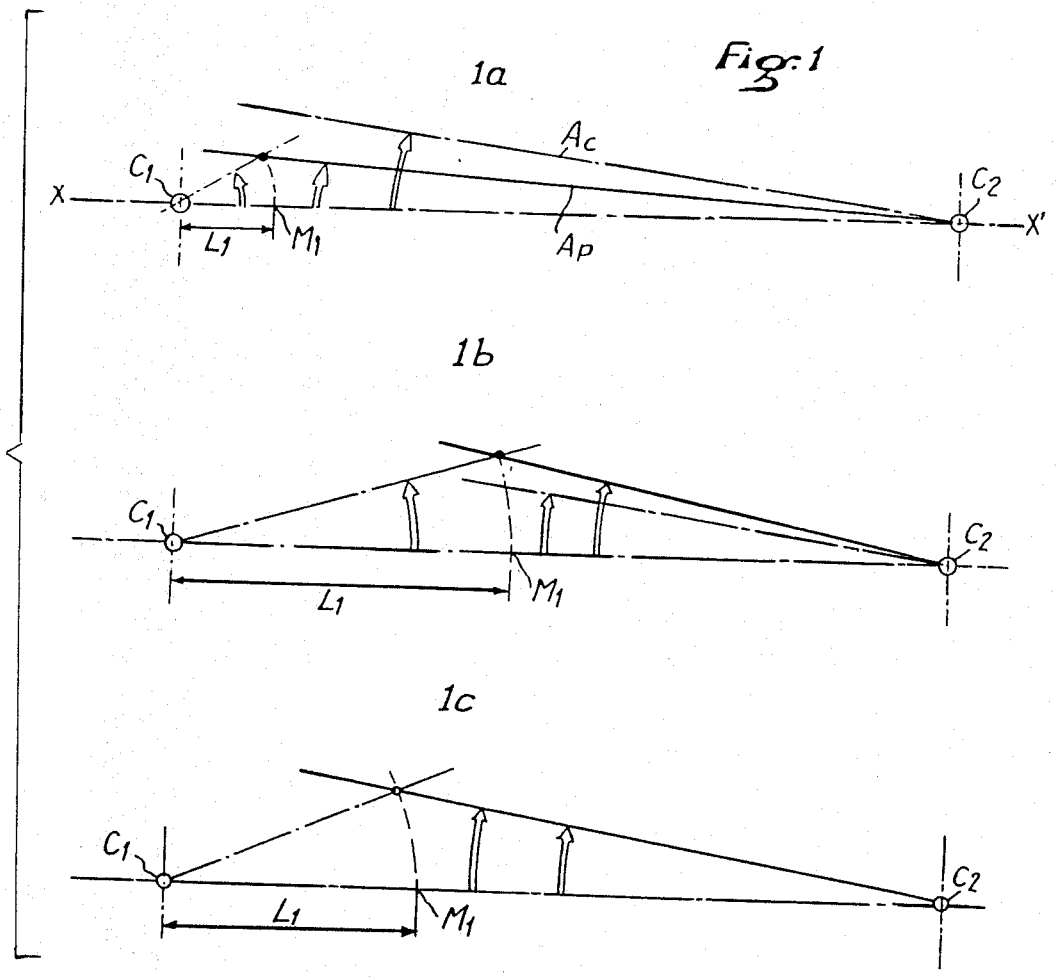
FIGS. 1*a*, 1*b*, 1*c* illustrates three schematic views in which the front abutment, the boot, and the plate simultaneous laterally pivot.

FIGS. 1*a*, 1*b*, and 1*c* show three schematic diagrams which illustrate the lateral pivoting of a front abutment which holds the front of the boot, lateral pivoting of the boot itself, and lateral pivoting of a plate positioned under the boot. As seen in FIGS. 1*a*, 1*b*, and 1*c*, $C_1$ refers to the axis around which the front abutment pivots, $M_1$ refers to lateral linkage means for linking the front abutment and the plate during lateral pivoting of these two elements, $C_2$ illustrates the axis around which the plate pivots, $L_1$ represents the distance separating the $C_1$ from $M_1$, $A_p$ represents the longitudinal axis of the plate, and $A_c$ represents the longitudinal axis of the boot.

As can be seen from FIG. 1*a*, when the distance $L_1$ is too small, the lateral rotation of the boot is greater than lateral rotation of the plate and the angle which $A_c$ makes with longitudinal axis XX' of the binding is greater than the angle which $A_p$ makes with longitudinal axis XX'. On the other hand, when $L_1$ is too large as seen in FIG. 1*b*, the lateral rotation of the plate is greater than the lateral rotation of the boot and the angle which $A_p$ makes with longitudinal axis XX' of the binding is greater than the angle which $A_c$ makes with longitudinal axis XX' of the binding. In both of these instances, friction is generated between the sole of the boot and the upper surface of the plate which influences the operation of the binding. FIG. 1*c* illustrates a value of $L_1$ for which $A_p$ and $A_c$ coincide during lateral pivoting of the boot and the plate. This value of $L_1$ depends upon the various dimensional parameters of the binding in the boot and must be determined for each particular binding and boot by successive drawings.

As seen in FIGS. 1*a*–1*c*, in order for the longitudinal axes of the boot and the plate to coincide, the position of linkage means $M_1$ cannot be any arbitrary position. More specifically, the position of linkage means $M_1$ must be neither too small nor too large in order for the longitudinal axis of the boot to coincide with longitudinal axis of the plate during lateral pivoting of these elements.

In addition to linking a plate and a front abutment during lateral pivoting of these elements, it is also necessary for the proper functioning of the present invention to link the plate to the front abutment during longitudinal displacement of the plate as will be discussed in more detail below. Because the plate and the front abutment are linked during longitudinal displacement of the plate, a torque is generated that acts on the front abutment to facilitate lateral rotation of the front abutment as will be discussed below. In order to have the best possible torque in order to facilitate this lateral rotation of the front abutment or to pivot the abutment upwardly, it is necessary that the linkage point between the plate and the abutment, designated as $M_2$, be as close a possible to the pivot axis of the front abutment or a support plane of the movable portion of the front abutment against a fixed support element.

Because the requirements for the optimum position of $M_1$ and $M_2$ are different, the object of the present invention is to disassociate $M_1$ and $M_2$ so that the distance between $C_1$ and $M_2$ is as small as possible, while the distance between $C_1$ and $M_1$ is determined so as to make axis $A_c$ and $A_p$ coincide during lateral pivoting of the plate and the boot.

Figure 2:
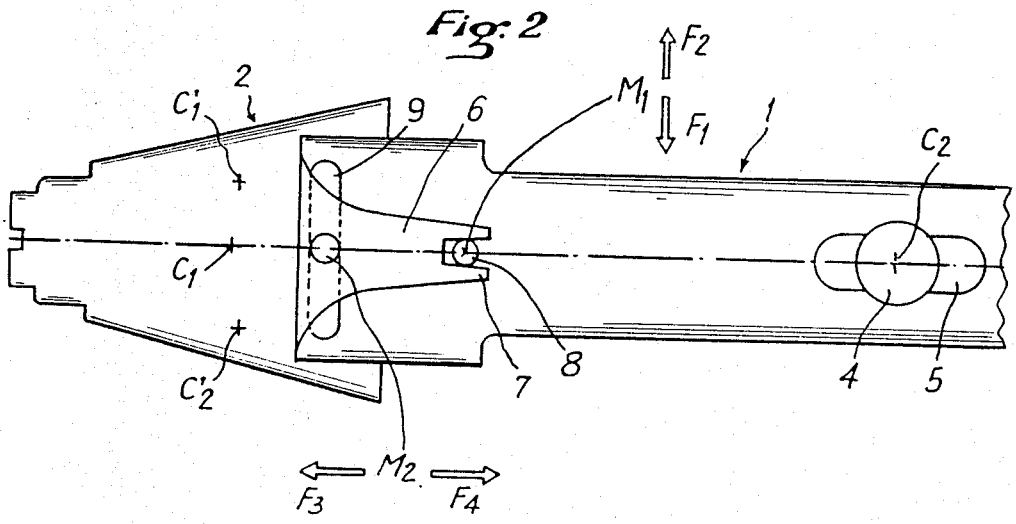
FIG. 2 illustrates a partial schematic view of means for linking the plate to the front abutment during lateral and longitudinal displacement of plate.

FIG. 2 schematically illustrates the binding of the present invention. As seen in FIG. 2 the binding of the present invention comprises a plate 1 which is pivotally mounted on a vertical pivot 4 so that plate 1 can laterally pivot around the substantially vertical axis passing through pivot 4. Pivot 4 is attached to the ski. In addition, plate 1 is slidingly connected to pivot 4 so that plate 1 can slide in a longitudinal direction of the binding and of the ski with respect to vertical pivot 4. This sliding and pivotal connection between plate 1 and vertical pivot 4 is accomplished by a window 5 which is positioned in plate 1. Window 5 is positioned so that pivot 4 extends therethrough. In addition, the length of window 5 in the longitudinal direction of the plate is greater than the diameter of pivot 4 to permit plate 1 to be longitudinally displaced with respect to pivot 4. This pivotable and sliding connection between plate 1 and pivot 4 is described in Applicant's French Pat. Nos: 8319397-8400346 8403525, which are hereby incorporated by reference thereto.

Front abutment 2 is pivotally mounted on the ski so that front abutment 2 can both laterally and vertically pivot against the bias of an elastic system which is known in the art. Front abutment 2 is adapted to pivot around pivot axis $C_1$ which passes through the longitudinal axis XX' of the ski in one embodiment. In another embodiment, front abutment 2 is adapted to pivot around either axis $C'_1$ or $C'_2$ which are spaced symetrically on either side of the longitudinal median plane of the binding and the front abutment.

As can also be seen in FIG. 2 abutment 2 also includes a tongue 6 which extends rearwardly from the rear of abutment 2. The rear end of tongue 6 comprises a fork 7 having two spaced apart arms which receives a pin 8 there between. Pin 8 is integral with plate 1 and projects upwardly from the upper surface thereof to engage the space between the two spaced apart arms of fork 7. Fork 7 and pin 8 together comprise means $M_1$ for integrally connecting plate 1 with abutment 2 when plate 1 and abutment 2 pivot laterally. More specifically, when the boot which is held by front abutment 2 overcomes the bias of the elastic system and pivots laterally, this causes front abutment 2 to pivot laterally. As a result of lateral pivoting of abutment tongue 6, abutment 2, which is attached to tongue 6 also pivots laterally. This lateral pivoting of tongue 6 is transmitted to plate via the engagement of pin 8 between the spaced apart arms of fork 7. Thus, means $M_1$ also comprises means for transmitting the lateral pivoting of abutment 2 to plate 1.

Plate 1 also comprises, adjacent to its front end, and in the front end portion of plate 1, a transverse window 9 which extends transversely to the longitudinal axis of the binding. Window 9 is adapted to receive therein a pin 10 which is integral with tongue 6 of abutment 2. PIn 10 can laterally slide within window 9 so as to permit lateral pivoting of plate 1 with abutment 2. Window 9 and pin 10 together comprise a means $M_2$ for integrally connecting plate 1 and abutment 2 during displacement of plate 1 in the longitudinal direction of the binding. This comes about, as will be described in more detail below, because during a forward fall the sole of the boot produces a force in a rearward direction on plate 1. As a result, the front surface or ramp of window 9 is displaced rearwardly against pin 9 thereby producing a force on front abutment 2. As a result, means $M_2$ comprises means for applying a traction force in a longitudinal direction to the front abutment in response to application of a force and/or displacement of plate 1 in a longitudinal direction of the binding. Forces $S_1$ and $S_2$ of forces which can pivot the boot and binding laterally, as seen in FIG. 2 and forces $F_3$ and $F_4$ as seen in FIG. 2 are forces which act on the plate 1 in a longitudinal direction either frontwardly or rearwardly, respectively.

FIGS. 3–6 illustrate a first embodiment of the binding of the present invention. In these figures, the rear portion of boot 11 is maintained in a heel binding 3 which is supported by pivoting plate 1. Heel binding 3 includes a stirrup in the form of two lateral arms 13 which pivotally attaches heel binding 3 with plate 1. Heel binding 3 is supported on top of a sole 12 of the heel of the boot, and a jaw 14 of front abutment 2 maintains the front tip of the boot. Front abutment 2 comprises a jaw 14 which is supported on both sides of the sole 12 of the boot and on top of sole 12 of the boot. Heel binding 3 is well known in and of itself and need not be described in detail except to note that heel binding 3 comprises a jaw 300 which is adapted to pivot against the bias of an elastic system around transverse axis 30 formed by lateral arms 13. Lateral arms 13 are journalled on plate 1 around transverse axis 130 positioned under the boot. Such a binding is described for example in French Pat. Nos. 1,363,895; 2,263,796; 2,248,680; 2,258,876; and French Application No. 84,841, which are all hereby incorporated by reference.

Figure 5:
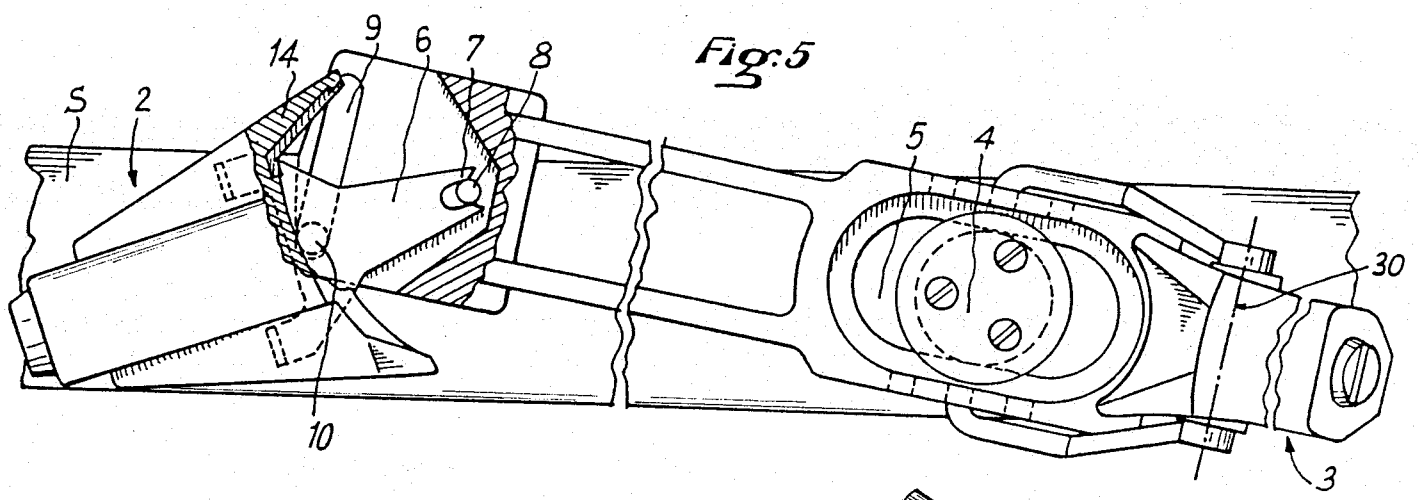
FIG. 5 also illustrates a planar view of the embodiment seen in FIG. 3 in partial cross-section, in which the binding is in a pivoted position, in which the binding is laterally pivoted away from its centered, rest position seen in FIG. 4.

In the event of a lateral fall in which the leg of a skier is subjected to torsional forces, the side of the boot (the right side of the boot shown in FIG. 5) causes abutment 2 to pivot laterally in the counterclockwise direction, as seen in FIG. 5, thereby causing a pivoting in an opposite direction of plate 1 at the point at which fork 7 engages pin 8. Of course, the lateral fall could also cause the left side of the boot to press against abutment 2, in which case abutment 2 and the boot would laterally pivot in the clockwise direction, thereby causing a pivoting in the opposite direction of plate 1 at the point at which fork 7 engages pin 8.

Figure 3:
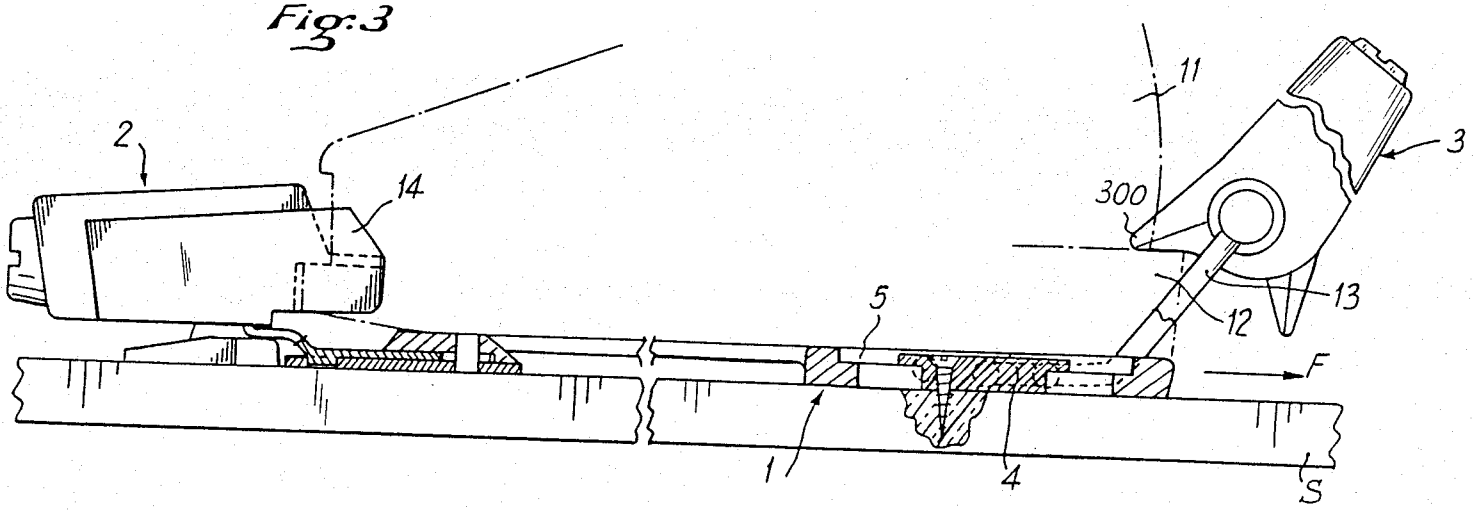
FIG. 3 illustrates a side elevational view of one embodiment of the invention in partial longitudinal cross-section.
Figure 4:
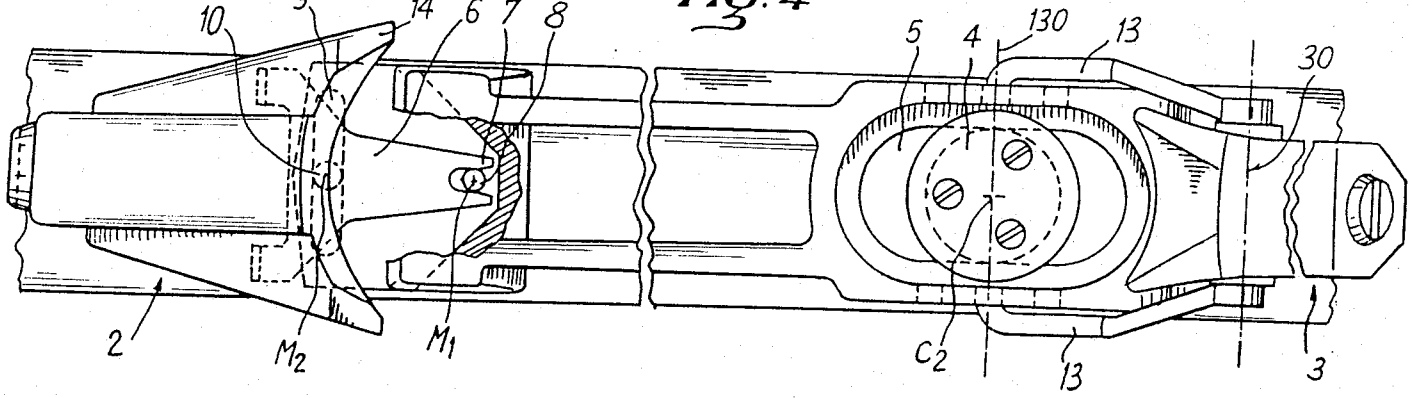
FIG. 4 illustrates a planar view of the embodiment seen in FIG. 3, in which the binding is in a centered or rest position with respect to the ski.
Figure 7:
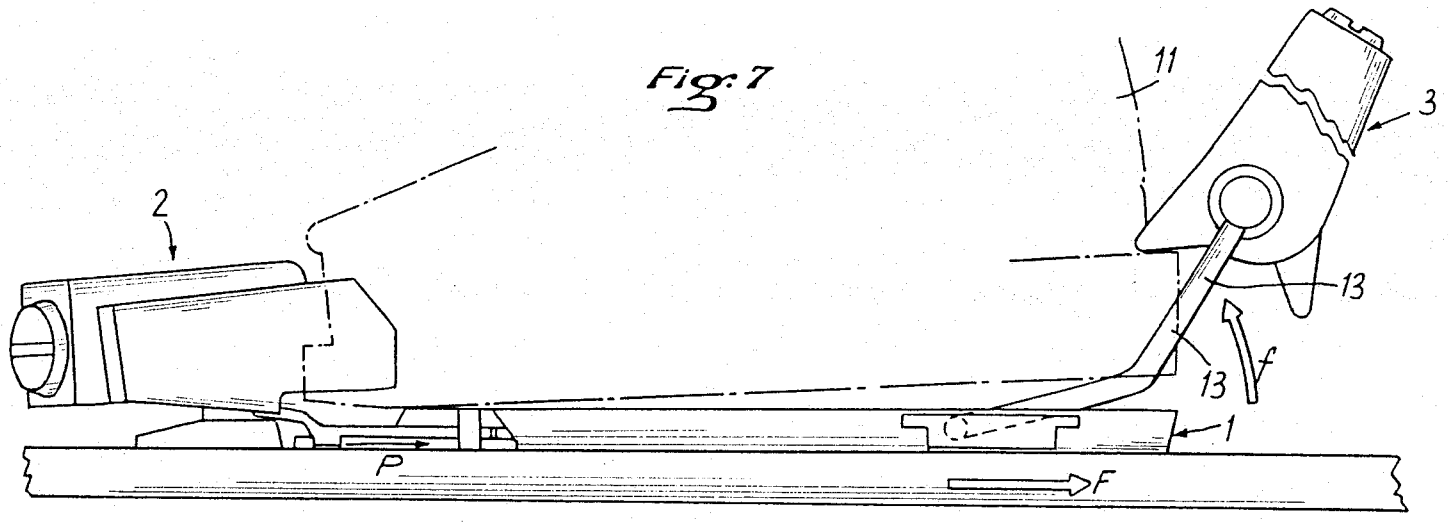
FIG. 7 is an schematic side elevational view illustrating a first embodiment of the present invention.

In the event of a frontward fall, as seen in FIG. 7, the lifting of boot 11 in the direction f causes an upward pivoting of lateral arms 13 around axis 130. In addition, the boot is supported at its front on front abutment 2. As a result, during upward lifting of the rear of boot 11 the pressure of the front of the sole of boot 11 against plate 1 causes plate 1 to move rearwardly in the direction F, with respect to pivot 4. This rearward force and displacement of plate 1 generates traction force P which is transmitted to abutment 2 by means of pin 10 being pressed on ramp 90 of window 9 (as seen in FIG. 6 which shows the various elements of the embodiment as seen in FIGS. 3–5 in an exploded and partially broken view to facilitate understanding of the binding seen in FIGS. 3–5).

In the event that a torsional fall is combined with a frontward fall, plate 1 and abutment 2 are integral with one another so that they pivot together by means of fork 7 and pin 8 (means $M_1$, and plate 1 and abutment 2 are integral with each other during longitudinal displacement of these two elements by means of pin 10 and window 9 (means $M_2$).

Figure 8:
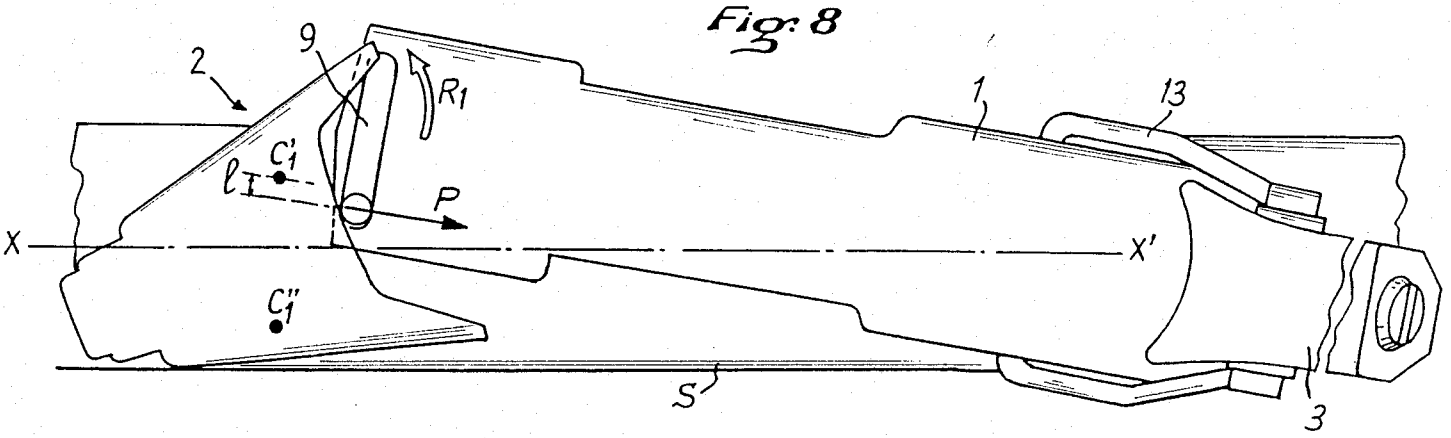
FIG. 8 is an schematic planar view of the embodiment as seen in FIG. 7 in which the binding is in a pivoted position which is laterally pivoted away from a centered rest position.

FIGS. 7 and 8 illustrate in more detail a first embodiment of the present invention having a front abutment 2 of the type which includes two axes of rotation which are symmetrically positioned with respect to the medium longitudinal plane of the abutment. This type of binding has been previously been described in French Pat. Nos. 2,334,382; 2,419,737; 2,478,476; and in French Application No. 81,22577 known as French Pat. No. 2,517,214 all of which are hereby incorporated by reference.

As discussed above, FIG. 7 shows that as a result of lifting of the heel of boot 11 in the direction of arrow f a force is generated which presses the upper of the boot against the abutment, thereby also generating a tractional force P toward the rear of the plate which pulls front abutment 2 rearwardly. As seen in FIG. 8, because the axis of rotation $C'_1$ is offset from a line passing through the point of application of force P, a torque or pivoting moment is generated which causes front abutment 2 to laterally pivot. The length of lever arm l diminishes until the angle of rotating plate 1 is such that force P passes through $C'_1$. When this angle of rotation has been reached the boot is freed from the binding.

Thus, in the event of a fall having a frontward and torsional component an additional torque is generated which laterally pivots front abutment 2 so as to automatically compensate for the breaking effect of friction which is generated by the tip of the boot being pressed against the ski.

Figure 9:
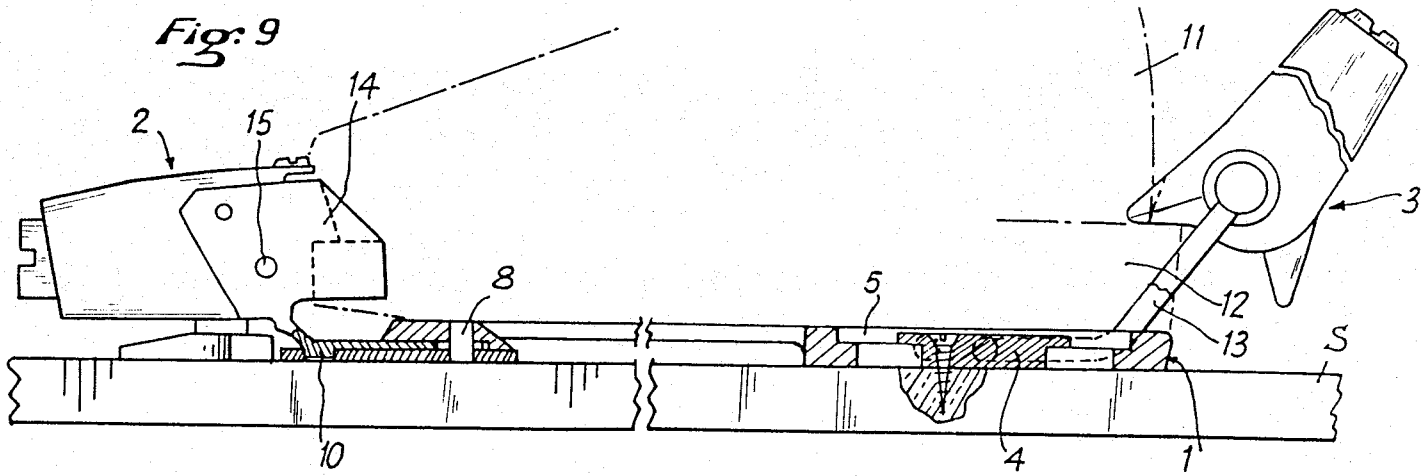
FIG. 9 illustrates a schematic side elevational view of second embodiment of the present invention.
Figure 10:
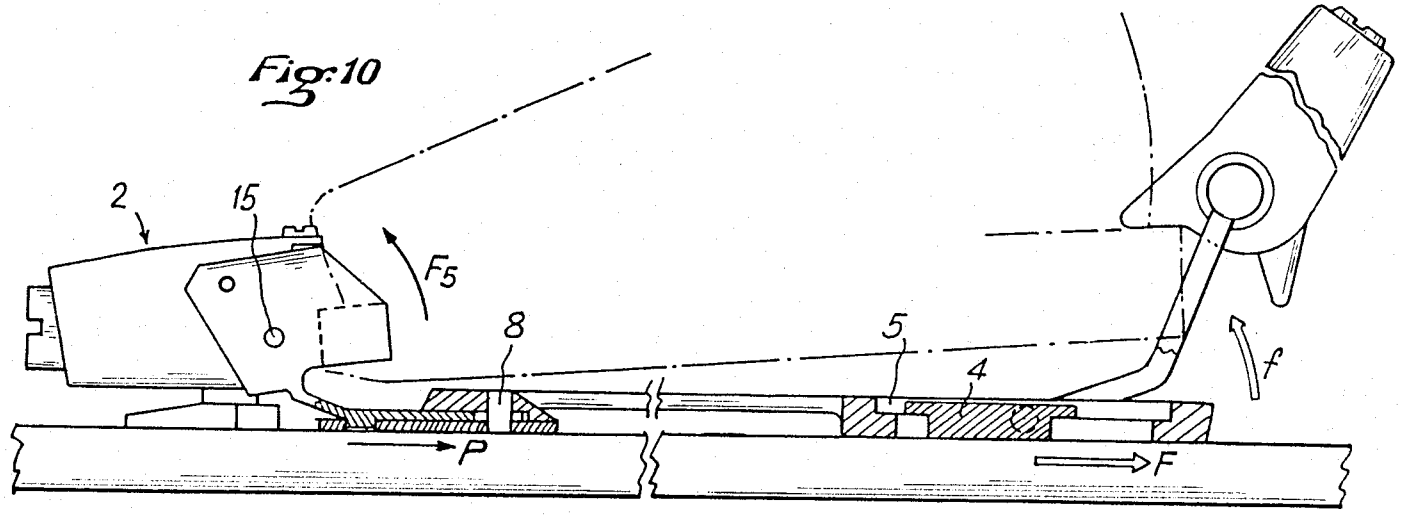
FIG. 10 illustrates a schematic elevational side view of the invention as seen in FIG. 9, in which the boot is slightly lifted upwardly.

FIGS. 9 and 10, illustrate a second embodiment of the present invention in which the front abutment is of a type which comprises a compensation mechanism for compensating for the friction between the boot and the ski which is actuated and activated by lifting of jaw 14 of the abutment. In FIGS. 9 and 10 the lifting of the heel in direction f causes a traction force P of plate 1 on front abutment 2 which in turn causes an upward rotation of jaw 14 of abutment 2 around the horizontal axis 15. This type of binding is of a type described in French Pat. Nos. 2,314,742; 2,424,037; and/or 2,385,418, all of which are hereby incorporated by reference, and which therefore will not to be discussed in detail. As is described in French Pat. No. 2,312,742, this upward pivoting of the boot causes a reduction in the bias of the elastic system on abutment 2 which in turn diminishes the return force of abutment 2 to its centered positioned. This reduction in the bias of the return force of the elastic system is produced by two journalled tipping elements which act on the elastic system in response to upward pivoting of jaw 14. As a result, there is also in this instance an automatic compensation for the friction of the boot against the ski which is caused by an increase in a pressure of the tip of the boot downwardly against the ski.

Figure 12:
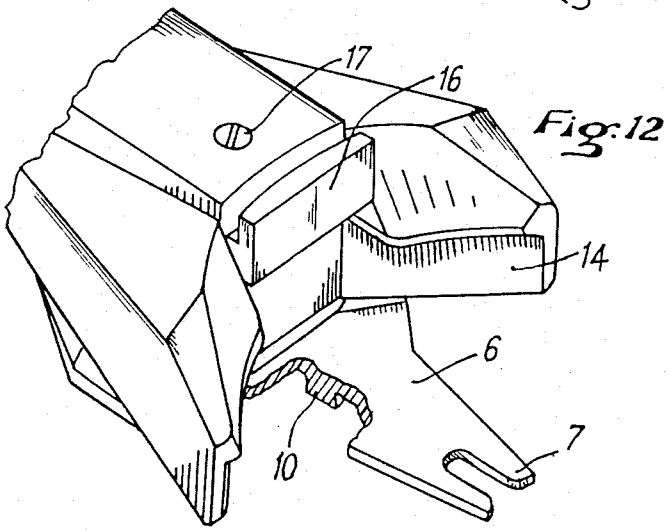
FIG. 12 illustrates a partial perspective view which is partially broken away of the embodiment seen in FIG. 11.
Figure 11:
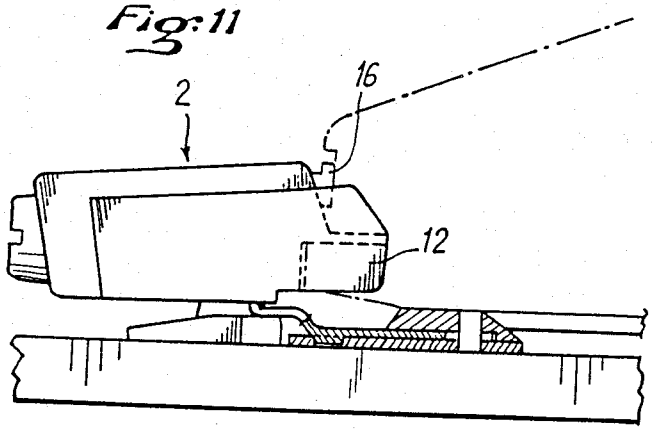
FIG. 11 illustrates a side elevational view of an alternative embodiment of the present invention.

As was described above, the lifting of the heel of the boot 11 in the direction of arrow f generates a tractional force P due to the pressing of the boot against abutment 2. Applicants have has discovered that the higher the point at which the upper of boot 11 presses against abutment 2, the greater the tractional force that is generated and therefore the greater the compensation for friction of the boot against the ski so as to assure a maximum value for traction force P. To achieve this maximum traction force, Applicants position a support plate 16 on the abutment for contacting the front tip of the upper boot 11. The vertical position of support plate 16 can be adjusted by means of screw 17 also illustrated in FIG. 12, so that support plate 16 can be positioned as high as possible.

In the embodiment illustrated in FIGS. 2–10, window 9 is rectilinear in shape. However, it is also within the scope of the present invention to use a window having a variety of configurations, for example a curved configuration as seen in FIGS. 13 and 14, so as to vary the transmission of traction force P of plate 1 to abutment 2. As seen in FIG. 13 window 900 is curved in the forward direction, and as seen in FIG. 14 window 901 is curved in the rearward direction. It should be noted that pin 10 supported by the abutment is adapted to contact a ramp 9, 91, or 92, as seen respectively in FIGS. 6, 13 and 14 when plate 1 is displaced in the rearward direction or when plate 1 experiences a force in the rearward direction. These ramps 9, 91 and 92 are positioned on the front surface windows 9, 900 and 901, respectively. In addition, it should also be noted that pin 8 engages and contacts ramp 70 to transmit the lateral pivoting of abutment 2 to plate 1. Ramp 70 is positioned on the inside surface of each lateral arm comprising fork 7.

It should also be noted, that in connection with this application that when the forward direction is referred to this forward direction is the normal direction of displacement of the ski, rather which is coincident with the direction of force $F_3$ as seen in FIG. 2. It should also be noted that in connection with this application that when the rearward direction is referred to this refers to the a direction 180 degrees from the forward direction, which is the same direction as force $F_4$ as seen in FIG. 2. Also, it should be noted that front abutment 2, plate 1, and boot 11 are normally in a centered, rest position as seen in FIGS. 2 and 4, and that when a torsional force is experienced by the boot and binding that front abutment 2, boot 11 and plate 1 will pivot laterally out of this centered, rest position as seen in FIGS. 5 and 8. In such a position, the longitudinal axis of the boot, front abutment 2, and plate 1 do not coincide with the longitudinal axis of the ski XX'. On the other hand, in the centered, rest position the longitudinal axis of boot 11, front abutment 2 and plate 1 coincide with and are parallel to axis XX' of the ski.

Figure 15:
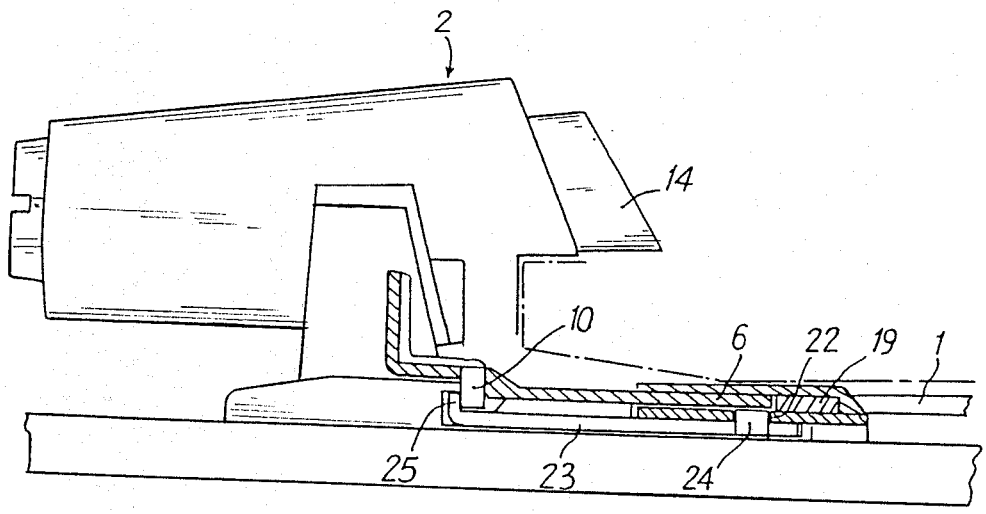
FIG. 15 illustrates a side elevational view of still another embodiment of the present invention.
Figure 16:
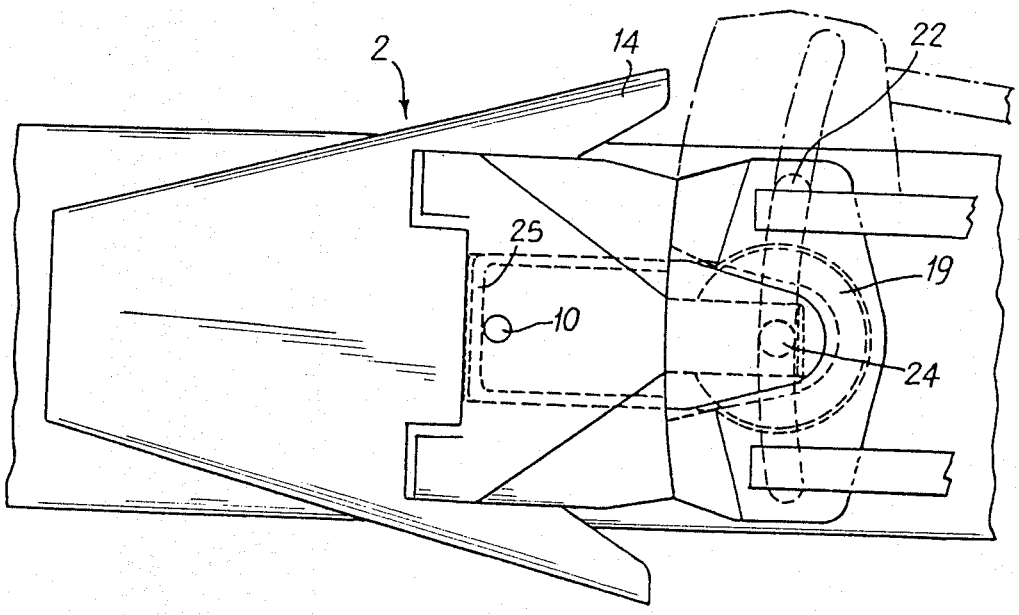
FIG. 16 illustrates a planar view of the embodiment seen in FIG. 15.
Figure 17:
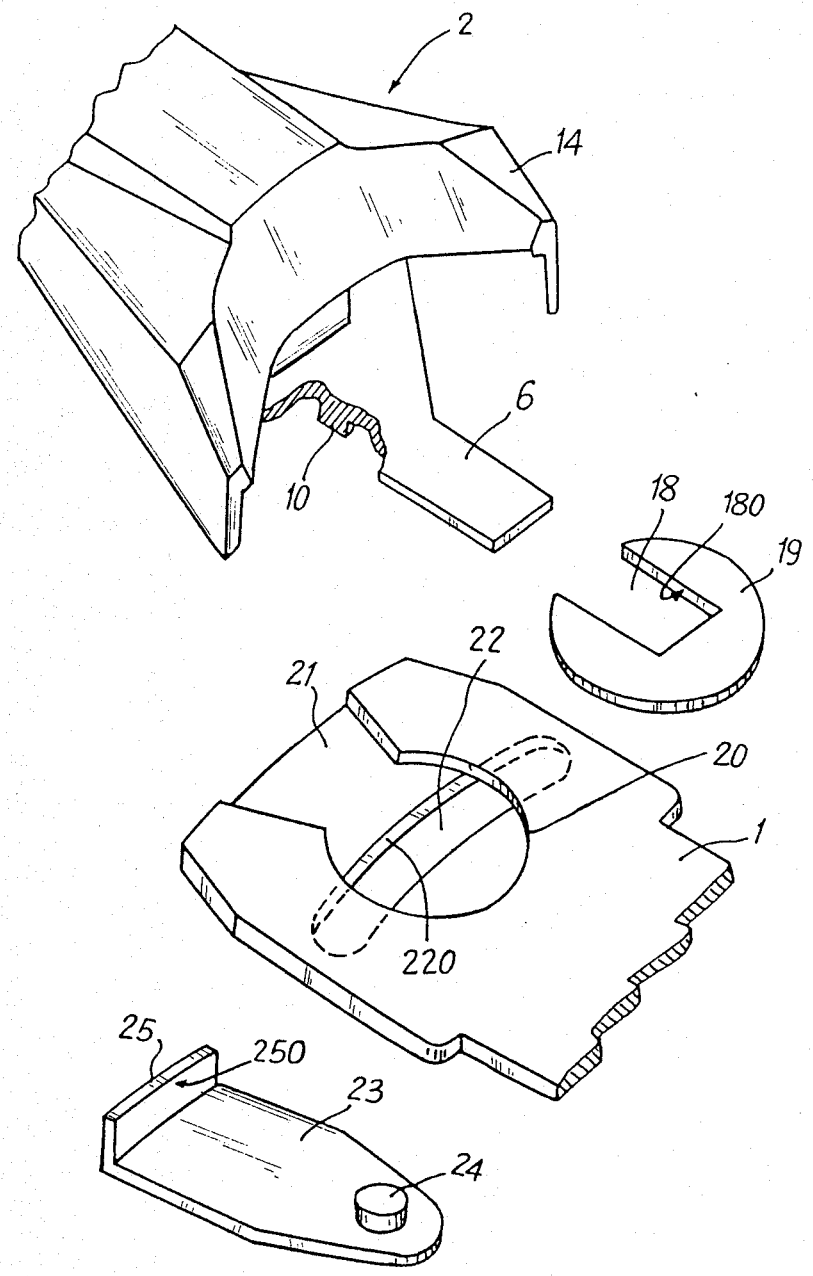
FIG. 17 illustrates a perspective view, exploded, and partially broken away, of the invention seen in FIGS. 15 and 16.

FIGS. 15–17 illustrate an alternative embodiment for means $M_1$ and $M_2$ for integrally connecting plate 1 and abutment 2 during longitudinal displacement of plate 1 and during lateral rotation and plate 1 and abutment 2. In this embodiment, a tongue 6 of abutment 2 also includes a pin 10, but no longer comprises fork 7 to cooperate with pin 8 carried by the plate. Rather, in this embodiment, tongue 6 is substantially rectangular in shape and engages a substantially rectangular opening 18 which is provided in a circular pivoting pin 19. Pivoting pin 19 is encased, but is nevertheless substantially free to rotate in a substantially circular opening of a housing 20 positioned at the front portion of plate 1. Housing 20 also includes an opening 21, which is conected to the substantially circular opening in housing 20. Opening 21 has a greater width than tongue 6 so as to permit lateral pivoting of tongue 6 when tongue 6 engages opening 18.

Beneath housing 20, plate 1 is provided with a window 22 which extends transverse to the longitudinal axis of the ski and binding. In addition, beneath plate 1 a smaller plate 23 is positioned. Plate 23 is provided at its rear end with a pin 24 which is adapted to engage window 22. In addition, plate 23 is provided at its front end with an edge 25 in the form of a ramp. Ramp 25 is adapted to be positioned in front of and immediately adjacent to pin 10 of tongue 6 so that plate 23 connects plate 1 with abutment 2. Pin 24 is adapted to be displaced within window 22 when ramp 25 is against pin 10.

The assembly formed by tongue 6 and pin 19 comprise means $M_1$, and the assembly comprising pin 10, ramp 25 and/or pin 24 and window 22 comprise means $M_2$. It is within the scope of the invention to use either assembly 10–25 or assembly 22–24 as means $M_2$.

In a preferred embodiment means $M_1$ and $M_2$ are positioned between $C_1$ and $C_2$. More specifically, means $M_2$ is positioned preferably between approximately 10 and 40 millimeters from $C_1$ and means $M_1$ is positioned at a distance of approximately between 50 and 90 millimeters from the center of rotation of $C_1$. In addition, means $M_1$ is preferably positioned between means $M_2$ and $C_2$, and means $M_2$ is positioned between $C_1$ and means $M_1$.

Although the invention has been described in reference to particular means, materials and embodiments, it is to be understood that the invention is not limited to the particulars disclosed but extends to all the equivalents within the scope of the claims.

What is claimed is:

1. A safety binding having a front abutment for holding the front of a boot on a ski and a vertical pivot wherein said binding comprises:

(a) an element positioned under said boot wherein said element is adapted to pivot around a substantially vertical axis passing through said vertical pivot and wherein said element is adapted to be displaced in translation on in the longitudinal direction of said binding with respect to said vertical pivot, wherein said element comprises:

(i) first means for linking said element to said front abutment, wherein said first linking means links said element to said front abutment during said longitudinal translational displacement of said element; and (ii) second means for linking said element to said front abutment, wherein said second linking means links said element to said front abutment during said pivoting of said element around said vertical pivot, wherein said first and second linking means are distinct from one another.

2. The binding defined by claim 1 in combination with said front abutment.

3. The binding defined by claim 1 in combination with said vertical pivot.

4. The binding defined by claim 1, wherein said boot comprises a heel portion, wherein said binding further comprises:

(b) a heel binding positioned on said element and adapted to hold said heel portion of said boot.

5. The binding defined by claim 1 wherein said element comprises a plate.

6. The binding defined by claim 1, wherein said element further comprises:

(iii) means for slidingly connecting said element to said vertical pivot so that said element is adapted to slide in said longitudinal direction with respect to said vertical pivot, wherein said connecting means comprises a window in said element, wherein said window is positioned so that said vertical pivot extends through said window, wherein the length of said window in the longitudinal direction of said element is greater than the diameter of vertical pivot.

7. The binding defined by claim 6 wherein said element further comprises:

(iv) means for pivotally connecting said element to said vertical pivot so that said element is adapted to pivot around a substantially vertical axis passing through said pivot, wherein said pivotally connecting means comprises said window positioned so that said vertical pivot extends through said window.

8. The binding defined by claim 1 wherein said first linking means comprises means for applying a traction force in the longitudinal direction to said front abutment in response to the application of a force in the longitudinal direction to said element.

9. The binding defined by claim 1 wherein front abutment is adapted to laterally pivot, wherein said second linking means comprises means for transmitting lateral pivoting of said front abutment to said element so that said element laterally pivots with said front abutment.

10. The binding defined by claim 1 wherein said first linking means comprises means for applying a traction force in the longitudinal direction to said front abutment in response to said longitudinal displacement of said element.

11. The binding defined by claim 10 wherein said front abutment is adapted to rotate around an axis, wherein and first and second linking means are positioned between said rotation axis of said front abutment and said substantially vertical pivot axis of said element.

12. The binding defined by claim 11 wherein said axis of rotation of said front abutment is substantially vertical.

13. The binding defined by claim 11 wherein said first linking means is positioned between said second linking means and said rotation axis of said front abutment.

14. The binding defined by claim 13 wherein said front abutment comprises a body portion and a tongue, wherein said rotation axis of said front abutment passes through said body portion, wherein said first linking means further comprises means for integrally linking said element with said front abutment, wherein said first linking means is positioned on said tongue immediately adjacent said body portion of said front abutment.

15. The binding defined by claim 14 wherein said first linking means is positioned between approximately 10 and 40 millimeters from said rotation axis of said front abutment.

16. The binding defined by claim 14 wherein said boot and said element each comprise a longitudinal axis and each are adapted to laterally pivot, wherein said second linking means comprises means for integrally linking said element and said front abutment, and wherein said second linking means is positioned at a distance from said rotation axis of said front abutment such that said longitudinal axes of said boot and said element substantially coincide during lateral pivoting of said boot and said element.

17. The binding defined by claim 16 wherein said second linking means is positioned between approximately 50 and 90 millimeters from said rotation axis of said front abutment.

18. The binding defined by claim 1 wherein at least one of said first and second linking means comprises a a first ramp and a first projection adapted to engage said first ramp.

19. The binding defined by claim 18 wherein said element has a front end portion, wherein said first linking means comprises said first ramp and said first projection, wherein said first projection is integral with said front abutment and said first ramp comprises a transverse ramp positioned at said front end portion of said element.

20. The binding defined by claim 19 wherein said transverse ramp is rectilinear in shape.

21. The binding defined by claim 19 wherein said transverse ramp is curved.

22. The binding defined by claim 19 wherein said element further comprises a window therein adapted to receive said first projection, wherein said window comprises a front end, wherein said front end of said window comprises said first ramp.

23. The binding defined by claim 19 wherein second linking element comprises a second projection and a second ramp, wherein said second projection is positioned at said front end portion of said element wherein said second ramp is integral with said front abutment and wherein said second ramp extends approximately in the longitudinal direction of said binding.

24. The binding defined by claim 23 wherein said front abutment further comprises a tongue extending rearwardly from said front abutment, wherein said tongue comprises an opening therein, wherein said opening extends in the longitudinal direction of said binding, wherein said second ramp is positioned in said opening of said tongue.

25. The binding defined by claim 1 wherein said element comprises a front portion, wherein said second linking means comprises:

(a) a tongue, integral with said front abutment, wherein said tongue comprises a fork attached to said tongue, wherein said fork comprises two spaced apart arms; and (b) a first pin supported by said element, wherein said first pin is adapted to slidingly engage between said two spaced apart arms of said fork;

wherein said first linking means comprises:

(a) a window positioned on said front portion of said element; and (b) a second pin, supported by said tongue, wherein said window is adapted to receive said second pin therein.

26. The binding defined by claim 1 wherein said second linking means comprises:

(a) a tongue attached to said front abutment; and (b) a pivoting element which is pivotally attached to said element, wherein said pivoting element has an opening therein adapted to receive said tongue, wherein said pivoting element is adapted to pivot in response to pivoting of said front abutment.

27. The binding defined by claim 26 wherein said element comprises a front end portion, wherein said pivoting element is pivotally attached to said front end portion, wherein said pivoting element comprises a substantially circular pin, wherein said second linking means further comprises:

(c) a housing attached to said front end portion of said element, wherein said housing comprises a substantially circular opening adapted to receive said substantially circular pin, wherein said substantially circular pin is adapted to substantially freely pivot in said substantially circular opening.

28. The binding defined by claim 27 wherein said tongue is substantially rectangular in shape and said opening in said pivoting element is substantially rectangular in shape.

29. The binding defined by claim 28 wherein said housing further comprises a front end portion connected to said substantially circular portion, wherein said front end portion of said housing has a width substantially greater than the width of said tongue to permit lateral pivoting of said tongue in said housing.

30. The binding defined by claim 26 wherein said first linking means comprises:

(a) a first pin integral with said tongue;

(b) a ramp attached to said element, wherein said ramp is positioned in front of and adjacent to said pin so that rearward displacement of said ramp causes a traction force on said pin, said tongue, and said front abutment.

31. The binding defined by claim 30 wherein said element comprises a front end portion having a window therein, wherein said first linking means further comprises:

(c) a plate comprising a second pin thereon, wherein said window in said element is adapted to receive said second pin therein, wherein said plate further comprises said ramp.

32. The binding defined by claim 31 wherein said plate comprises a front end portion and a rear end portion, wherein said ramp is positioned at said front end portion of said plate and said second pin is positioned at said rear end portion of said plate.

33. The binding defined by claim 1 in combination with said front abutment, wherein said boot comprises an upper having a front tip, wherein said front abutment comprises a rear portion and a support positioned on said rear portion, wherein said support supports said front tip of said upper of said boot.

34. The binding defined by claim 33 wherein said front abutment further comprises means for adjusting the height of said support, wherein said adjusting means comprises an adjustment screw.

35. The binding defined by claim 1 in combination with said front abutment, wherein said front abutment is attached to said element, wherein said front abutment comprises means for pivoting said front abutment about two axes of rotation positioned symmetrically on both sides of a longitudinal median plane of said front abutment.

36. The binding defined by claim 1 in combination with said front abutment, wherein said front abutment comprises a jaw and means for compensating for friction between said boot and said ski, wherein said element is attached to said front abutment, wherein said compensation means is actuated by upward pivoting of said jaw.

37. The binding defined by claim 1 in combination with a heel binding positioned on said element, wherein said heel binding comprises:

a jaw for holding said boot; and two lateral arms connecting said jaw with said element, wherein said two lateral arms form a transverse axis around which said jaw is adapted to be displaced, wherein said lateral arms are journalled on said element around another transverse axis positioned under said boot.

* * * * *

UNITED STATES PATENT AND TRADEMARK OFFICE

CERTIFICATE OF CORRECTION

PATENT NO. : 4,709,942

DATED : December 1, 1987

INVENTOR(S) : DIMIER, Jean-Pierre et al.

It is certified that error appears in the above-identified patent and that said Letters Patent is hereby corrected as shown below:

At column 2, line 36, change "pivot" to ---point---.

At column 6, line 40, change "partailly" to ---partially---.

At column 6, line 43, change "an" to ---a---.

At column 6, line 45, change "an" to ---a---.

At column 7, line 59, change "a" beginning of line (1st occurrence) to ---as---.

At column 8, line 46, insert ---l--- after "plate".

At column 8, line 56, change "PIn" to ---Pin---.

At column 9, line 68, delete "been" (2nd occurrence).

At column 10 line 52, delete "has".

At column 11, line 18, delete "rather".

At column 11, line 21, delete "the" after "refers to" (2nd occurrence).

At column 13, line 20, change "wherein and" to ---and wherein---.

At column 13 line 57, delete "a" 1st or 2nd occurrence.

Signed and Sealed this

Seventeenth Day of January, 1989

*Attest:*

*Attesting Officer*

DONALD J. QUIGG

*Commissioner of Patents and Trademarks*